US005101240A

United States Patent [19]

Pendell et al.

[11] Patent Number: 5,101,240

[45] Date of Patent: Mar. 31, 1992

[54] SYSTEM FOR ALIGNING A PRINTER WITH A FINISHER

[75] Inventors: Patrick T. Pendell; Joel L. Respress; Susan L. West, all of Rochester, N.Y.

[73] Assignee: Xerox Corporation, Stamford, Conn.

[21] Appl. No.: 608,052

[22] Filed: Oct. 31, 1990

[51] Int. Cl.[5] ..... G03G 21/00

[52] U.S. Cl. ..... 355/323; 271/207; 271/289; 271/292

[58] Field of Search ..... 340/679, 686; 355/200, 355/209, 321, 322, 323, 324, 325; 271/207, 213, 289, 290, 292

[56] References Cited

U.S. PATENT DOCUMENTS

| | | | |
|---|---|---|---|
| 3,076,647 | 2/1963 | Lowe et al. | 270/58 |
| 3,848,867 | 11/1974 | Johnson | 271/173 |
| 3,853,314 | 12/1974 | Anderson | 271/173 |
| 4,405,225 | 9/1983 | Perrault | 355/323 |
| 4,515,458 | 5/1985 | Masuda et al. | 355/313 |
| 4,585,333 | 4/1986 | Yamagishi | 355/202 |
| 4,711,444 | 12/1987 | Geurts | 271/290 |
| 4,783,681 | 11/1988 | Tanaka et al. | 355/202 |
| 4,968,016 | 11/1990 | Koyama | 271/292 |

*Primary Examiner*—A. T. Grimley
*Assistant Examiner*—Patrick J. Stanzione
*Attorney, Agent, or Firm*—William A. Henry, II

[57] ABSTRACT

A modular, customer installable bypass paper transport allows printed output from a printer to bypass an output tray of the printer and pass directly into a separate finisher so as to ensure no detrimental impact on the IOT of the printer when the units are coupled or decoupled. The bypass transport fits into an output tray of the finisher and is powered by the printer. Alignment is accomplished by the use of two switches on the mating end of the bypass transport that have plunger type actuators that are actuated with minimal contact with the separate finisher in order to indicate correct or incorrect docking of the separate finisher with the bypass transport.

3 Claims, 9 Drawing Sheets

SYSTEM FOR ALIGNING A PRINTER WITH A FINISHER

Reference is hereby made to the following copending applications with a common assignee including U.S. application Ser. No. 07/608,053, entitled Customer Installable Sheet Bypass Transport for Connecting a Printer to a Finisher by Patrick T. Pendell et al. and U.S. application Ser. No. 07/607,404, entitled Customer Installable Bypass Sheet Transport with Cover Assembly and Locating Springs by James L. Sloan et al., both of which are incorporated herein by reference.

This invention is directed to copiers/printers/duplicators, and more particularly, to an apparatus for facilitating hook-up of third party finishing equipment to such copiers/printers/duplicators. The primary product of printing businesses, and the like, is customer pertinent information printed on paper. This product takes many forms: from stacks of loose sheet print to stuffed, sealed and metered envelopes. Some products do not have the capability to prepare a full range of output products, and therefore, do not meet all of needs of the customer. As designed, these machines can deliver stacked output and stitched output. Those users of such equipment, but requiring other forms of output, must take these two forms of output to other locations for further finishing operations. This is perceived by some as a limitation on such equipment, and this limitation generates an expense of manually transporting output from one operation site to another.

In view of the aforegoing, there is a need to accommodate printers, or the like, with output devices that will increase capability and utility of the printers.

In the past, various output devices have been designed for connection to printers, or the like, e.g., a copying machine having a sorter connected to it is disclosed in U.S. Pat. No. 4,515,458. The copying machine can be operated in a book mode or sheet mode and the sorter can be selected to operate in a collator or sorter mode by a control unit. Copy papers ejected from the copying machine are passed through a bridge mechanism to the sorter.

U.S. Pat. No. 3,853,314 discloses a collating apparatus for use in association with copying machines having a plurality of sheet receiving trays. The sheets are conveyed by means of a distribution mechanism which includes belts and supporting pulleys.

U.S. Pat. No. 4,711,444 is directed to a sorting device for use with copying machines. The device comprises a plurality of superposed sheet receiving bins, a first conveyor for selectively feeding conveyed sheets to the receiving bins, and a second conveyor for conveying sheets from a copier to the first conveyor. The second conveyor includes an operative and an inoperative position.

In U.S. Pat. No. 3,067,647, a collating machine is disclosed integrated in a cooperative relationship with a printing machine. Separate stacking and handling of printed sheets at the printing machine are eliminated as the collating machine receives each sheet as it is printed through a conveyor belt.

U.S. Pat. No. 3,848,867 discloses a sheet distributor which receives paper from a printer and distributes the printed sheets to various stations. The sheets are delivered to the sheet distribution apparatus by a sheet conveyor.

All of the aforementioned references are incorporated herein by reference.

These devices, while serving as output devices for printers, or the like, do not answer the need for a convenient, low-cost means of aligning a printer with finishing equipment of third party manufacturers.

Attempts at answering this problem in general include U.S. Pat. No. 4,405,225 which discloses a collator that has a built-in microprocessor. The collator also has an interconnecting switch for allowing other modules to be added on to it. The output from the interconnection switch is fed to a logic control unit within the collator. Direct communication with the photocopier to which the collator is attached is by direct wiring so that information may be interchanged between the two logic control means. In U.S. Pat. No. 4,585,333, a separated communication system between a copying machine and its subsystems is shown wherein an optical connection is established, a light emitting diode (LED) in the subsystem emits light which is picked up by a phototransistor in the copier. The copier uses the subsystem only when light is detected by the phototransistor. Two LEDs are provided to permit various signals to be transmitted between the copier and the subsystem. U.S. Pat. No. 4,783,681 discloses an image processing system wherein a plurality of recording units are coupled together electrically and mechanically. A pair of push sensors detect whether or not the units are coupled. Correct horizontal alignment is assured when both sensors are closed. Control signals are passed between the two units through the coupling. A control system is shown which determines whether or not proper alignment and coupling has occurred and displays a fault if there is a problem. It is apparent from these patents that there is still a need for a convenient, low-cost means of aligning a printer with finishing equipment of third party manufacturers.

Accordingly, a system for allowing copy sheet output from a printer to pass into third party finishing equipment and ensure no detrimental impact on the input output terminal (IOT) of the printer when it is coupled to or decoupled from the finishing equipment is disclosed that involves minimum contact between the printer and finishing equipment. The system comprises two plunger type switches positioned on the output end of the printer that are designed to disable the printer unless actuators (raised pads, bosses, etc.) on the finishing equipment are properly aligned laterally, horizontally and vertically with them.

Other features of the present invention will become apparent as the following description proceeds and upon reference to the drawings, in which.

While the present invention will hereinafter be described in connection with a preferred embodiment thereof, it will be understood that this is not intended to limit the invention to that embodiment. On the contrary, it is intended to cover all alternatives, modifications and equivalents as may be included within the spirit and scope of the invention as defined by the appended claims.

Figure 1A:
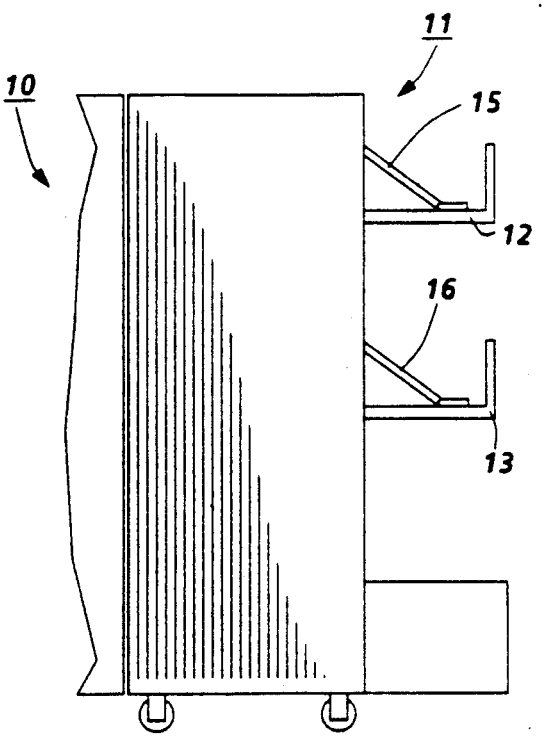
FIGS. 1A–1C show a schematic elevational view of a conventional printer that includes a conventional output device with an output tray and a bypass transport installed in the tray that includes alignment switches in accordance with the present invention.
Figure 1B:
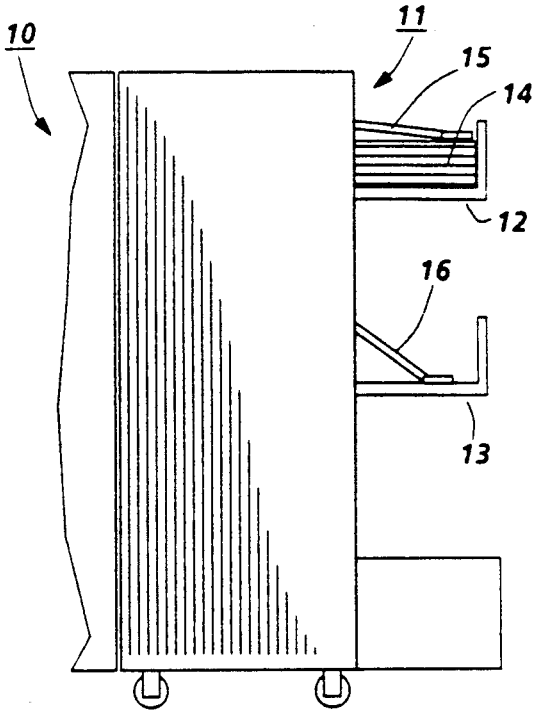
Figure 1C:
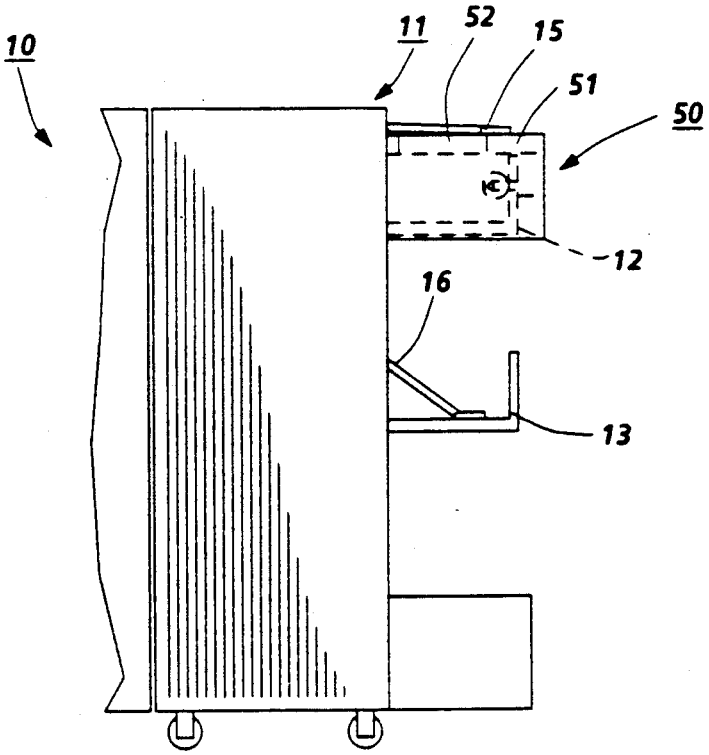
Figure 6:
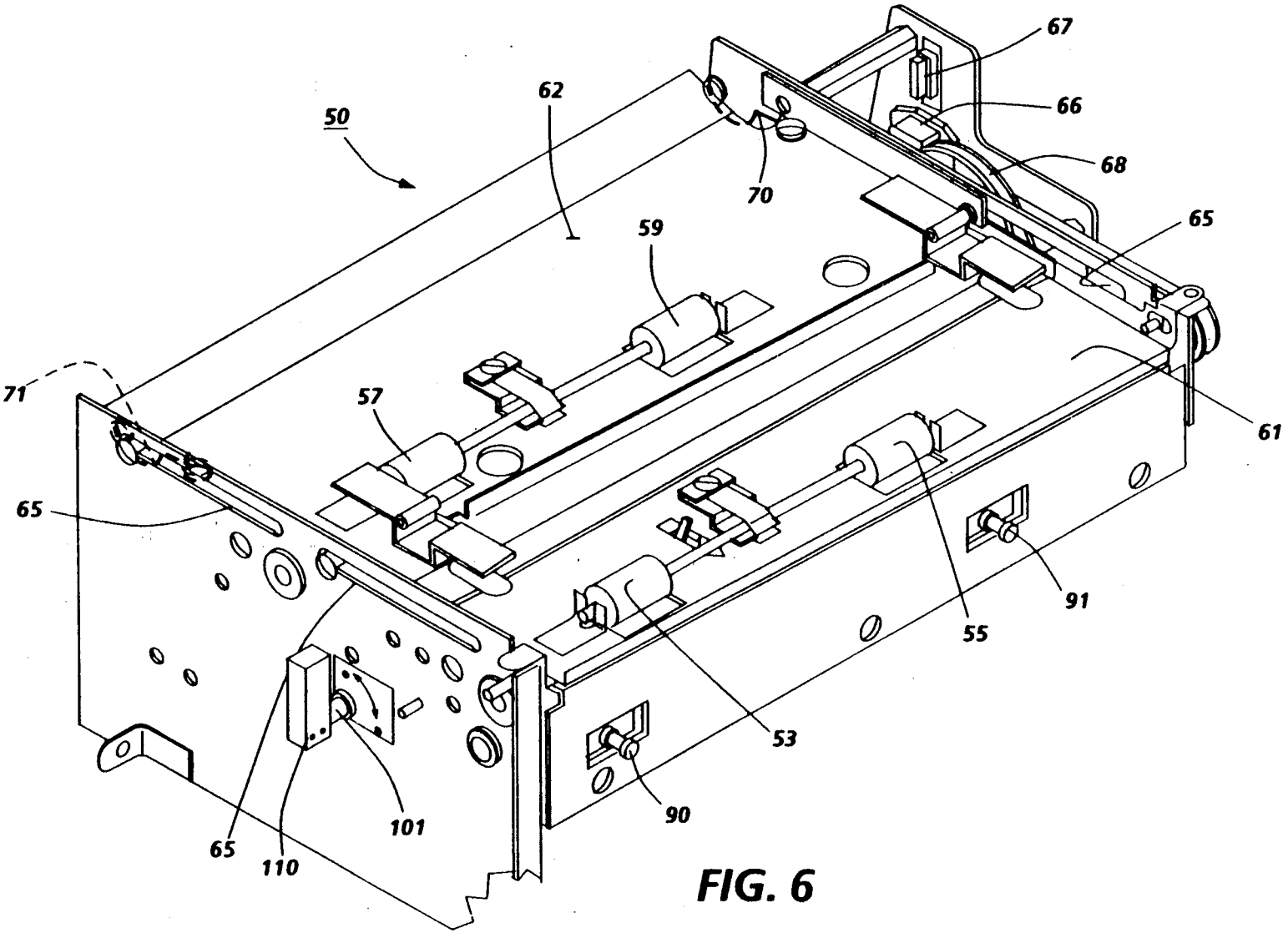
FIG. 6 is a partial isometric view of the bypass transport of FIG. 1 with its covers removed.

For a general understanding of the features of the present invention, reference is made to the drawings. In the drawings, like reference numerals have been used throughout to designate identical elements where FIG. 1A schematically depicts a conventional two-bin stacker 11 connected to a conventional printer 10, such as, the Xerox 4090®. In FIG. 1B, the stacker 11 is shown with copy sheets 14 filling bin 12 and held in place by normal force member 15. The copy sheets have been removed from bin 12 in FIG. 1C and replaced by a bypass transport 50. Bypass transport 50 weighs about 30 lbs and is lifted to the height of the tray and pushed in toward the rear of stacker 11. The distance it can be pushed is limited by a feature on its cover. Inside the front cover, as shown in FIG. 6, there is a handle 110 which, when turned, locates the transport properly from left to right. The transport receives power from the two-bin stacker through a power cord which extends from the back of stacker 11 to the back of the transport. The transport also receives signals through a similar cable located the same way. These two cables are plugged in by the user during installation. At this point, the bypass transport is ready to deliver printed output to third party finishing equipment.

Figure 2:
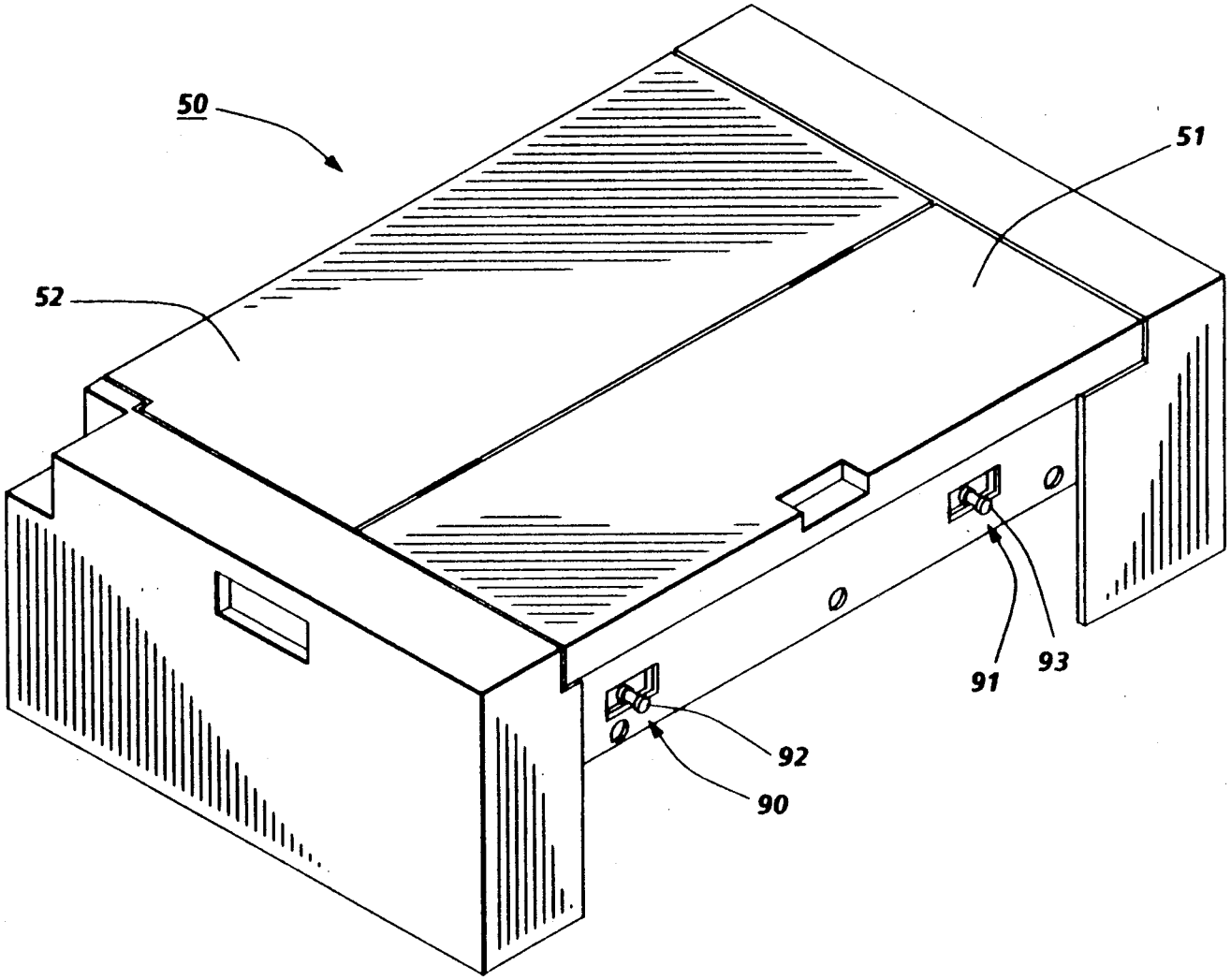
FIG. 2 is an isometrical schematic of the bypass device showing alignment switches of the present invention.

It should be apparent that alignment of third party equipment with bypass transport 50 is essential if smooth flow of copy sheets from the bypass transport to the third party equipment is to be accomplished. It is not desirable to physically mount the unknown mass of third party equipment to the 30 lb transport because the certain weight mismatch will cause significant damage if some outside force tries to move the third party equipment out of alignment. Also, it would not be desirable to mount the third party equipment to the base frame of the host printer 10 because unknown third party equipment vibrations could be transmitted to the base machine and potentially, could effect copy quality. For these reasons, and in accordance with the present invention, bypass transport 50 is shown in FIG. 2 with switches 91 and 92 mounted on its right hand end having plunger type actuators 93 and 94. This type of connection system allows minimum contact between modules while simultaneously enhancing alignment between the modules. The third party equipment is required to have similarly located parts on its left hand end in order to compress the plungers as the third party equipment approaches the bypass transport. Compressing the plungers changes the state of the switches, e.g., opened to closed, closed to opened. The firmware or logic of the host printer will monitor the state of the switches, such that it knows if one of them is not compressed when it should be. The switches are wired such that, if only one of them is not compressed, the logic signal being monitored changes levels.

Figure 3:
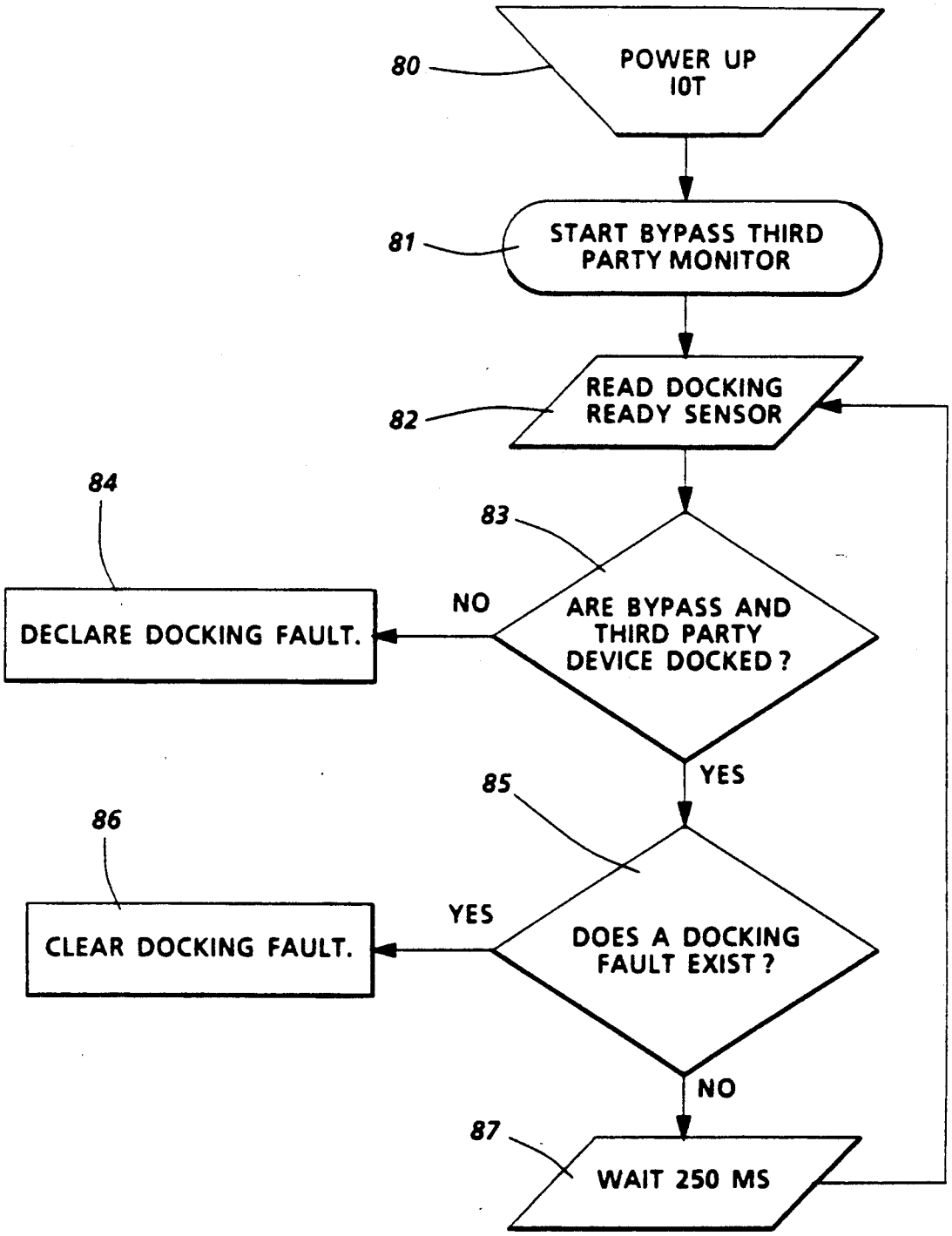
FIG. 3 is a Logic Flow Diagram that controls alignment of the bypass transport with third party finishers.

The logic flow diagram in FIG. 3 shows the operation of the bypass transport 50 in which the host printer 10 is powered up in block 80 and monitoring of the bypass transport and third party equipment is initiated in block 81, while the read docking and ready sensor is initialized in block 82. If the bypass transport and third party equipment are not docked as monitored in decision block 83, a fault is declared in block 84. But, if the docking of the bypass transport and the third party equipment is indicated, a decision in block 85 is made as to whether a docking fault exists. If a docking fault does exist, it is indicated in block 86 and cleared. When no docking fault exists, decision block 85 sends a signal to block 87 where a wait of 250 ms expires before a signal is sent to the ready sensor in block 82. The bypass transport is now properly connecting output from printer 10 to the third party equipment.

Figure 4A:
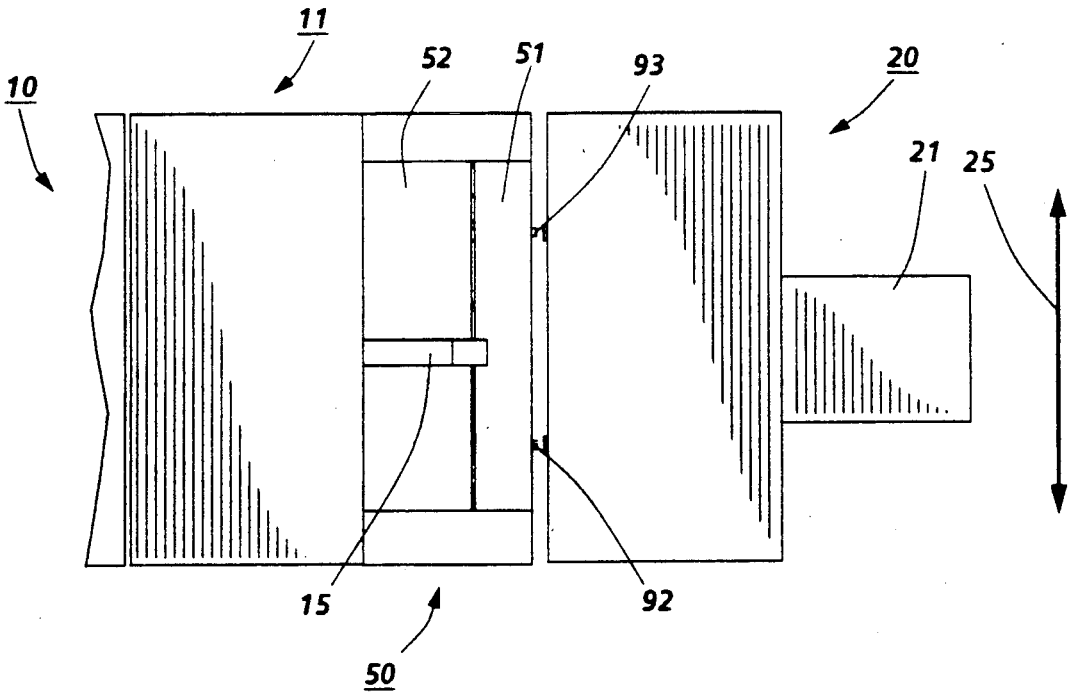
FIGS. 4A and 4B show partial schematical top and side views of the bypass apparatus of FIG. 1C mounted in an output tray of a printer apparatus, or the like, and the types of alignment of third party equipment that is controlled.
Figure 4B:
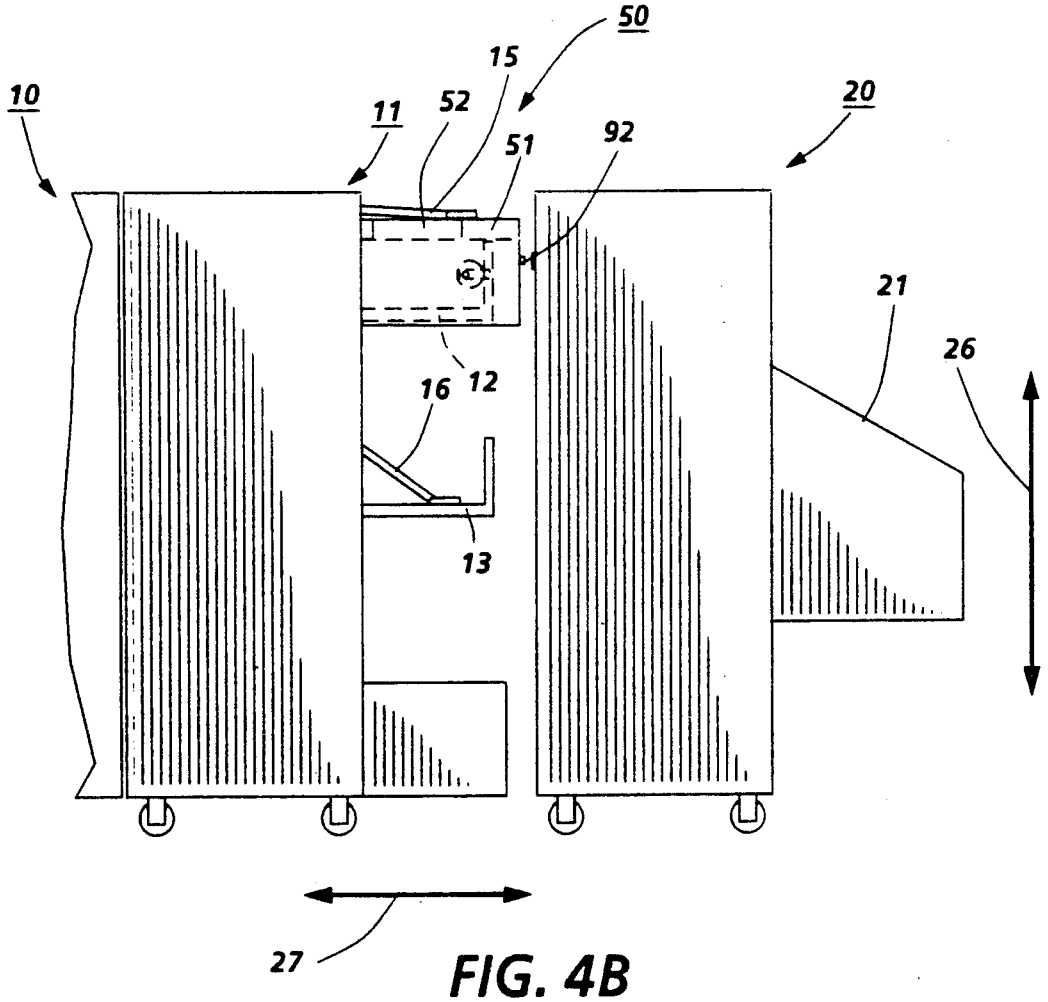

Switches 90 and 91 are wired such that, if only one of them is not compressed, the logic of FIG. 3 being monitored changes levels. The detectable types of the misalignment are shown in FIGS. 4A and 4B in that any significant amount of misalignment from any of three planes will be detected by the sequence of the flow diagram in FIG. 3 and result in a machine shutdown. Shutdown is followed by a message displayed to the machine operator stating the nature of the fault, (e.g., Third Party Docking Fault). The fault may not be reset unless the switches are again compressed. In FIG. 4A, a top view of stacker 11, bypass transport 50 and third party finisher 20 with output bin 21 is shown with arrow 25 indicating detectable side-to-side misalignment. Misalignment in a vertical, as well as, horizontal plane is detectable in FIG. 4B as indicated by directional arrow 26 and 27, respectively.

Figure 5A:
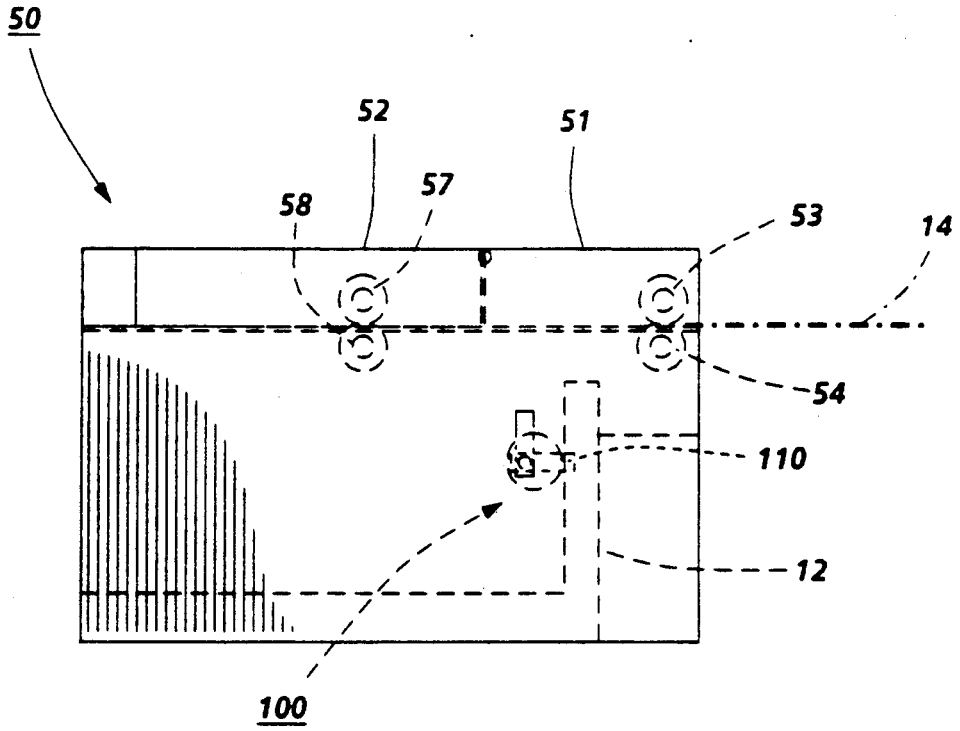
FIGS. 5A and 5B are schematic partial side views of the bypass transport of FIG. 1C showing its cover in a closed, as well as, open position.
Figure 5B:
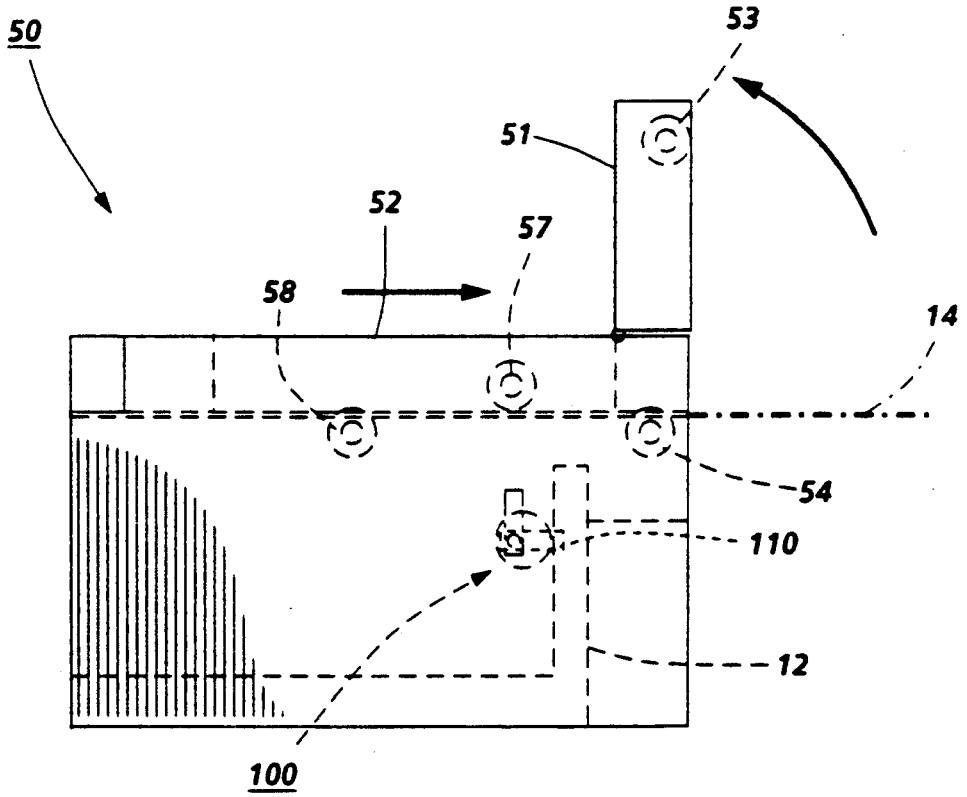
Figure 7:
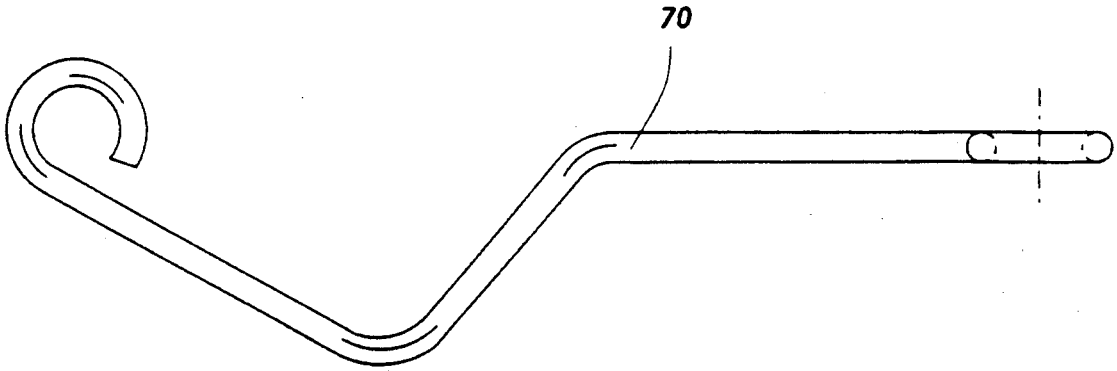
FIG. 7 is a side view of one of two spring steel wires used to properly position idler rolls with mating drive rolls in the bypass transport.

During jam clearance procedure for bypass transport 50 in the unlikely event of a paper jam, the alignment of roller pairs (53, 54), (55, 56), (57, 58) and (59, 60) in FIGS. 5A, 5B and 6 is upset. To clear a jam, top cover portion 51 is opened and with cover portion 52 are slid to the right in FIG. 5B. This motion separates the roller pairs, therefore, a means is necessary to positively restore roller alignment when cover portion 51 is closed and both cover portions 51 and 52 are slid to the left to resume their position in FIG. 5A in order to prevent further jams where misaligned rollers would cause copy sheets to feed downward and jam or wrinkle as opposed to feeding horizontally as designed. This potential problem is answered by two spring steel wire form springs 70 and 71 in FIG. 7 attached to cover baffle assembly 62. The springs extend into a notch in the bottom baffle beneath baffle assembly 62. When the covers 51 and 52 are being slid toward their home position after having been slid to the right and cover 51 opened in FIG. 5B, the springs are in a stressed state. As the springs begin to enter the notch at the home position they actually pull the cover assemblies into position. The positioning of the springs and notches during assembly allows the roller pairs to be properly aligned. Cover assemblies 51 and 52 are prevented from traveling beyond the proper alignment by the length of the slots 65 within which they slide.

Figure 9:
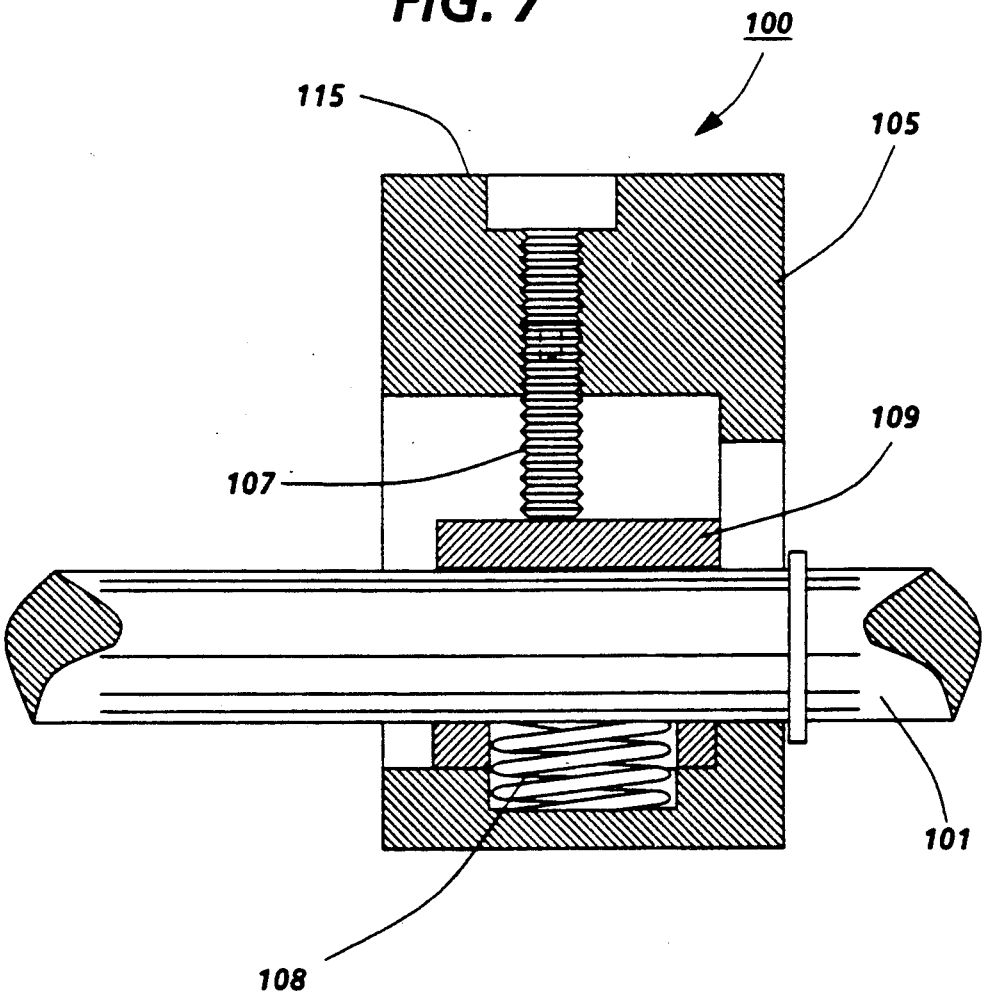
FIG. 9 is a partial, enlarged elevational view of a cam positioning device as shown in FIG. 8.
Figure 8:
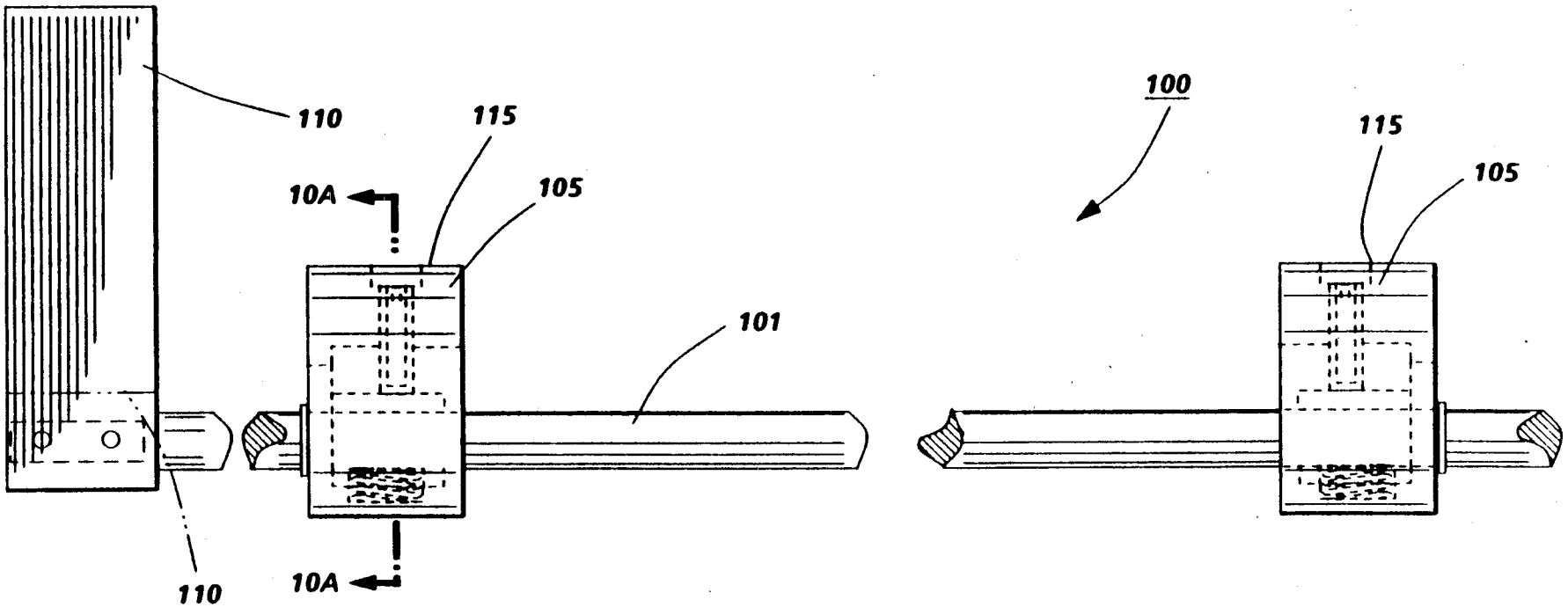
FIG. 8 is an elevational view of an adjustable cam positioning device used in the bypass transport of FIG. 2.
Figure 10A:
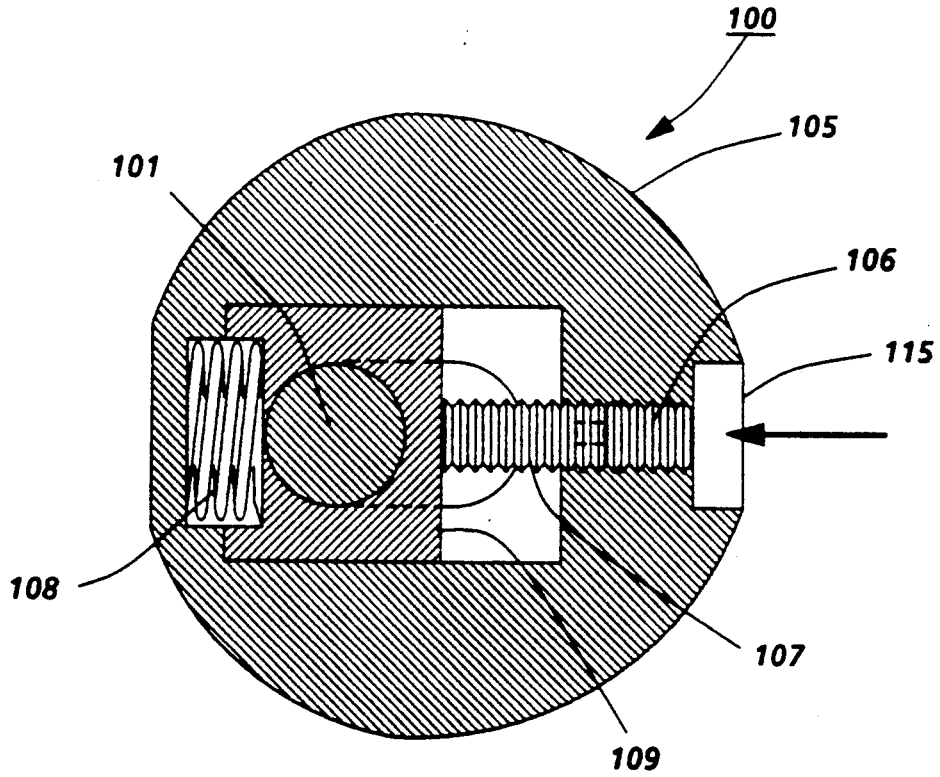
FIGS. 10A and 10B show an enlarged cross-section of a the cam positioning device of FIG. 8 in an adjusted position in FIG. 10A and in a standard position in FIG. 10B.

In order to compensate for manufacturing tolerances of the stacker and predicted manufacturing tolerances of the bypass transport, bypass transport 50 is designed so that its maximum size is smaller than the minimum output tray size. In most situations, this will result in some amount of space around the transport which will allow movement during operation. To avoid paper travel difficulties, this extra space has to be consumed in order to prevent movement of the transport assembly. The mechanism for accomplishing this an adjustable cam positioning device 100 shown in FIGS. 8–10. The adjustable cam positioning device comprises a shaft 101 with a pressed on block 109 which nominally is concentrically positioned through a cam 105. The cam has a slot therein to house the shaft. Shaft 101 may be moved to any eccentric location within limits of the slot by virtue of a screw 107 pushing on one side of block 109 and a compression spring 108 on the other. Both screw 107 and spring 108 are housed in cam 105. The amount of eccentricity is only limited by the size of the cam and length of the slot.

Figure 10B:
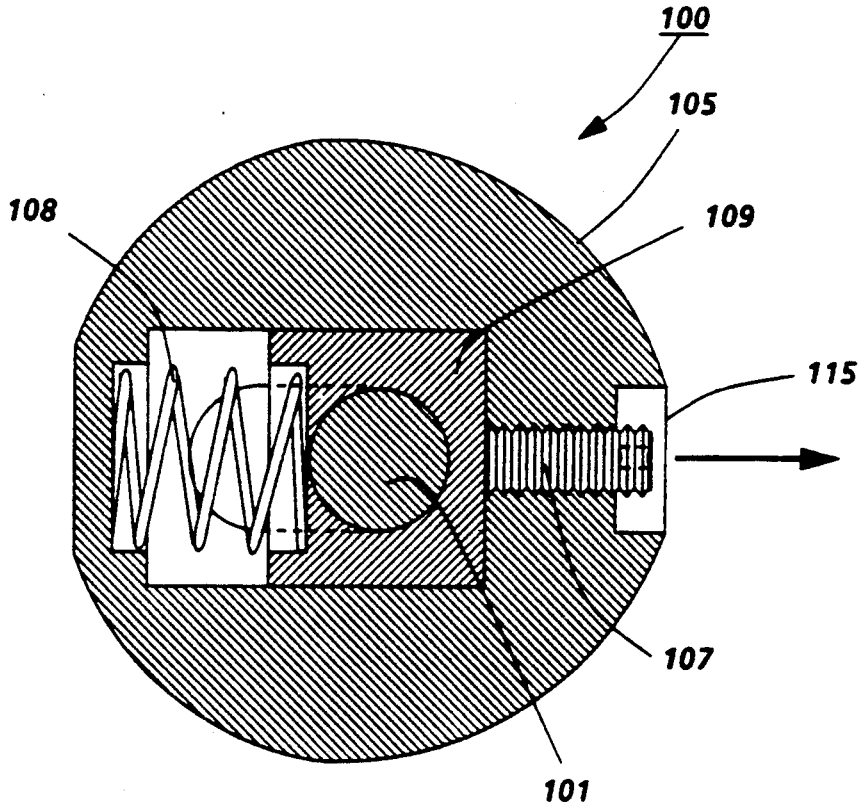

Normally, cam 100 is in the position shown in FIG. 10B when the bypass transport is placed in the bin of a stacker by a service technician. Handle 110 is then rotated to the right in order to estimate the amount of play between flat cam surface 115 and the inside surface of the end of the stacker bin. Handle 110 is then rotated to the left and screw 107 is turned within threads 106 with a screw driver by way of holes in lower baffle 62 in order to force flexible shaft 101 a small amount through block 109. Handle 110 is again turned to the right to see if the cam has been adjusted sufficiently to ensure a proper fit between flat cam surface 115 and the inside surface of the end of the stacker bin. This process is repeated until a satisfactory fit is obtained. Thereafter, all an operator has to do is lift the transport out of the bin and place it into a bin as desired since the tolerance has been adjusted previously.

It should now be apparent that an alignment system for an operator installable bypass sheet transport system is disclosed which can transport a printed output from one piece of finishing equipment to another piece of finishing equipment on-line. The bypass transport is housed in a selected bin of a multi-bin finisher and receives power and control signals from the multi-bin finisher in order to deliver the printed output to a separate finisher. By way of example, bypass transport 50 is connected to stacker 11 by way of AC connector 66 and connector 67 and as mentioned hereinbefore, power comes into the transport through connector 67 and signals through connector 66. Copy sheets are driven through the transport by a conventional pulley system 68 through drive rollers 54, 56, 58 and 60 and out of an exit path beneath assembly baffles 61 and 62.

What is claimed is:

1. An alignment system for aligning a first piece of finishing equipment to a second piece of finisher equipment, comprising: a modular, portable, operator installable copy sheet bypass transport adapted to be inserted into a bin of said first piece of finishing equipment to accept copy sheets forwarded to said first piece of finishing equipment from a printer and transport them directly to said second piece of finisher equipment, said bypass transport including means for electrically connecting said bypass transport to said first finishing equipment and baffle means for forming a predetermined path through which copy sheets are driven between said first piece of finishing equipment and said second piece of finishes equipment, said bypass transport includes plunger type switches that are adapted to be compressed by one end of said second piece of finisher equipment, and control means for receiving a signal from said switches when said second piece of finisher equipment is placed thereagainst and indicating a correct docking or incorrect docking signal to an operator.

2. The alignment system of claim 1, wherein said second piece of finisher equipment includes members that mate with said plungers during correct alignment of first piece of finishing equipment with said second piece of finisher equipment.

3. An alignment system for aligning a first piece of finishing equipment with a second piece of finisher equipment, comprising: switch means including plungers positioned on one end of said first piece of equipment for indicating whether or not said first piece of finishing equipment and second piece of finisher equipment are properly aligned laterally, horizontally and vertically, and actuator means on said second piece of finisher equipment for actuating said switch means by pushing in said plungers when said first piece of finishing equipment and second piece of finisher equipment are brought together, and control means for receiving a signal from said switches when said second piece of finisher equipment is aligned with said first piece of equipment in order to indicate a laterally, horizontally and vertically correct docking or incorrect docking of said first piece of equipment with said second piece of finisher equipment.

* * * * *